United States Patent [19]

Robbins, III

[11] Patent Number: 4,835,820

[45] Date of Patent: Jun. 6, 1989

[54] BAG CLOSURE DEVICE

[76] Inventor: Edward S. Robbins, III, 459 N. Court St., Florence, Ala. 35630

[21] Appl. No.: 151,271

[22] Filed: Feb. 1, 1988

[51] Int. Cl.[4] ..... B65D 77/10

[52] U.S. Cl. ..... 24/30.5 R; 24/543

[58] Field of Search ..... 24/30.5 R, 30.5 P, 30.5 W, 24/447, 543, 90 HA; 294/147; 383/15, 17, 117; 292/322

[56] References Cited

U.S. PATENT DOCUMENTS

| | | | |
|---|---|---|---|
| Re. 23,629 | 3/1953 | Henriksen . | |
| 829,661 | 8/1906 | Lucke et al. . | |
| 2,700,805 | 2/1955 | Bedford, Jr. . | |
| 3,001,254 | 9/1961 | Schumm . | |
| 3,416,196 | 12/1968 | Mathison | 24/90 HA |
| 3,621,539 | 11/1971 | Ayers | 24/30.5 R |
| 3,912,140 | 10/1975 | Franges | 383/15 |
| 4,128,922 | 12/1978 | Hutchison . | |
| 4,197,982 | 4/1980 | de Lima Castro Netto . | |
| 4,275,485 | 6/1981 | Hutchison . | |
| 4,291,698 | 9/1981 | Fuchs et al. | 24/543 |
| 4,370,778 | 2/1983 | Madsen | 24/30.5 R |
| 4,441,233 | 4/1984 | Swift . | |
| 4,536,924 | 8/1985 | Willoughby | 24/543 |

*Primary Examiner*—Victor N. Sakran

*Attorney, Agent, or Firm*—Nixon & Vanderhye

[57] ABSTRACT

A bag closure device includes a pair of annular closure members which are movable into and out of a nested relationship with one another and are preferably connected to one another by an integral hinge. In the preferred embodiment, one of the closure members is L-shaped in configuration and defines a concave seating surface while the other closure member is U-shaped in configuration and defines a convex engagement surface. The convex engagement surface is thus positioned annularly adjacent to the seating surface when the two closure members are nested so as to frictionally capture, and thus close, a portion of a flexible bag therebetween. An annular lip may be formed on the L-shaped closure member so as to provide frictional resistance against separation of the closure members when they are nested. Further removable locking capability may be provided by a cooperating aperture (defined in a foldable tab associated with one of the closure members) and an upright stake (associated with the other closure member) having an enlarged head press-fitted through the aperture. Tamper evidence may also be provided by a melted terminal segment of the stake.

30 Claims, 2 Drawing Sheets

BAG CLOSURE DEVICE

RELATED APPLICATIONS

This application is related to commonly owned and copending U.S. patent application Ser. No. 07,141,042 filed in the U.S. Patent and Trademark Office on Jan. 5, 1988 in the name of Edward S. Robbins, III, et al, the entire content of this related copending application being expressly incorporated hereinto by reference.

FIELD OF THE INVENTION

This invention relates to devices of the type used to close flexible bags. In a preferred embodiment it includes a pair of annular closure members which are movable into and out of a nested relationship with one another (which movement may be facilitated by an integral hinge interconnecting the closure members). One of the closure members is preferably L-shaped in configuration and defines a concave seating surface, while the other closure member is preferably U-shaped in configuration and defines a convex engagement surface. When a portion of a flexible bag is positioned between the pair of closure members and the closure members are moved into their nested relationship, the bag portion will be captured between the annularly adjacent seating and engagement surfaces thereby closing the bag.

BACKGROUND AND SUMMARY OF THE INVENTION

It is oftentimes desirable to reclose a bag once it has been opened, particularly if the bag contains a food product which would spoil or become stale if the bag was allowed to remain open. It would also be beneficial for the bag to be sealed by the manufacturer, food processor, or the like (after the bag is filled with a marketable product) with a tamper resistant device which could subsequently be utilized to reclose the bag (and hence protect the bag's contents from spoilage) once it has been opened by a purchaser. In such a situation, the purchaser would benefit from visual assurances that the bag had not been opened prior to its being purchased (i.e., so that the purchaser is assured that no-one has tampered with or adulterated the contents of the bag).

Various contrivances have been proposed in the past in order to accomplish bag-closure functions. For example, U.S. Pat. No. 3,001,254 to Schuum discloses a bag closure device which is comprised of a web having a projecting rib and an opening formed on its respective halves. A disc with an annular groove, and a ring are provided at respective opposite ends of the web. In use, the web is folded onto itself (as is more easily permitted by means of a hinge part) such that the ring catches in the annular groove. The rib, in turn penetrates into the opening so that the bag therebetween is forced at least partially through the latter (i.e., so that it "bulges" through the opening). In such a manner, the device of Schuum U.S. Pat. No. 3,001,254 closes a bag.

A divided circular handle for carrying mesh bags is disclosed in U.S. Pat. No. Re. 23,629 to Henriksen. The handle of Henriksen U.S. Pat. No. Re. 23,629 is comprised of two halves which define respective arcuate tongues slidably matable with one another. In use, the bag is attached to the lower parts of each of the halves, and one of the tongues is slid under the other tongue. Thus, the bag is dependently supported by the handle when the halves are mated with one another but is capable of being opened when the two halves are separated.

Lucke et al in U.S. Pat. No. 829,661 disclose a bag lock which is comprised of a strap whose ends include a recessed keeper (having an annular flange) and a cylindrical case lock (having bolts). When the case lock is pressed into the keeper, the bolts will snap behind the flange thereby securing the lock and keeper one to the other.

A number of bendable bag closure devices are also known in the art, one such device being shown in U.S. Pat. No. 2,700,805 to Bedford, Jr. Usually, bag closure devices of this type will be formed from a bendable material (e.g., metal ribbon) so that it is capable of being manually deformed into and out of gripping relationship with a bag top so as to respectively close and open the same.

As the reader will appreciate, there still exists a need in this art for a bag closure device which not only is capable of reclosing the bag once it has been opened, but which is also capable of being used by a product manufacturer in the first instance to close the bag prior to being shipped to the consumer market. A need is also present for such a bag closure device which provides the consumer purchaser with a visual indication of the integrity of the bag's contents—that is, an indication that the bag has not been opened prior to purchase. The present invention is directed towards such needs.

According to this invention, a bag closure device is provided with a pair of annular (e.g., circular ring-shaped) closure members which are nestable with one another. In the preferred embodiment, one of the closure members is generally L-shaped in cross-sectional configuration while the other closure member is generally U-shaped in cross-sectional configuration. The L-shaped one of the closure members is thus provided with an upright flange, and a shelf which extends outwardly from the flange towards the other U-shaped closure member and defines an annular concave seating surface. The U-shaped closure member, on the other hand, is provided with an opposing pair of upright, spaced-apart wall segments which are integrally joined at their bottoms to define an annular convex engagement surface.

When the two closure members are nested, the convex engagement surface will be positioned in an annularly adjacent relationship to the concave seating surface so as to capture a portion of a flexible bag therebetween. In such a manner, the bag is closed by means of the device of this invention.

The two closure members are most preferably joined to one another by an integral hinge which facilitates foldable movement of the closure members relative to one another into and out of their nested relationship.

The nesting of the two closure members may be enhanced by an annular lip formed on a terminal end of the shelf of the L-shaped closure member. The lip bears against one of the upright wall segments of the U-shaped closure members and thus serves to frictionally resist separation of the two closure members from their nested relationship.

Locking capability and/or visual tamper evidence is optionally provided with the device of this invention by means of, for example, an upright stake (associated with one of the closure members) and a tab and aperture member (associated with the other closure member). The stake may be provided with an integral enlarged head (i.e., enlarged as compared to the diameter of the aperture) so that it can be press-fitted through the aperture and releasably lock the two closure members one to another while they are in their nested relationship. The stake and integral enlarged head may be, for example, similar to the structure disclosed in U.S. Pat. No. 4,441,233 issued to Allan W. Swift on Apr. 10, 1984 (the entire content of which is expressly incorporated by reference herein).

Visual tamper evidence is most conveniently established by at least partially melting the terminal end portion of the stake which extends through and beyond the aperture defined in the tab to an extent where the stake and tab are melded to one another thereby forming a tamper evident "seal". In such a situation, any previous opening of the bag will immediately visibly be apparent by virtue of the separation and/or abnormal distortion of the seal formed between the stake and tab.

Other features and advantages of this invention will become more clear to the reader after careful consideration is given to the following detailed description of the preferred exemplary embodiments thereof.

BRIEF DESCRIPTION OF THE DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENT

Figure 1:
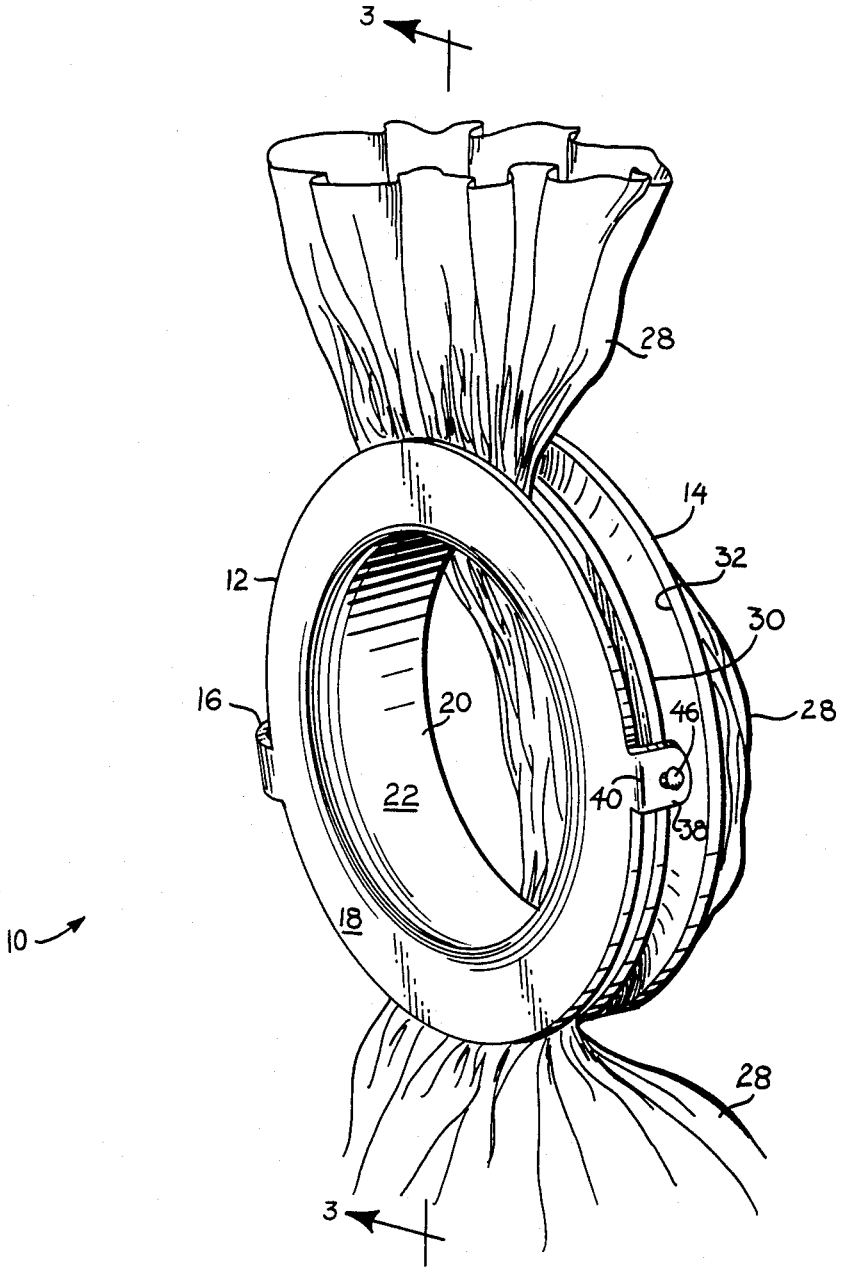
FIG. 1 is a perspective elevational view of a bag closure device of this invention in use.
Figure 2:
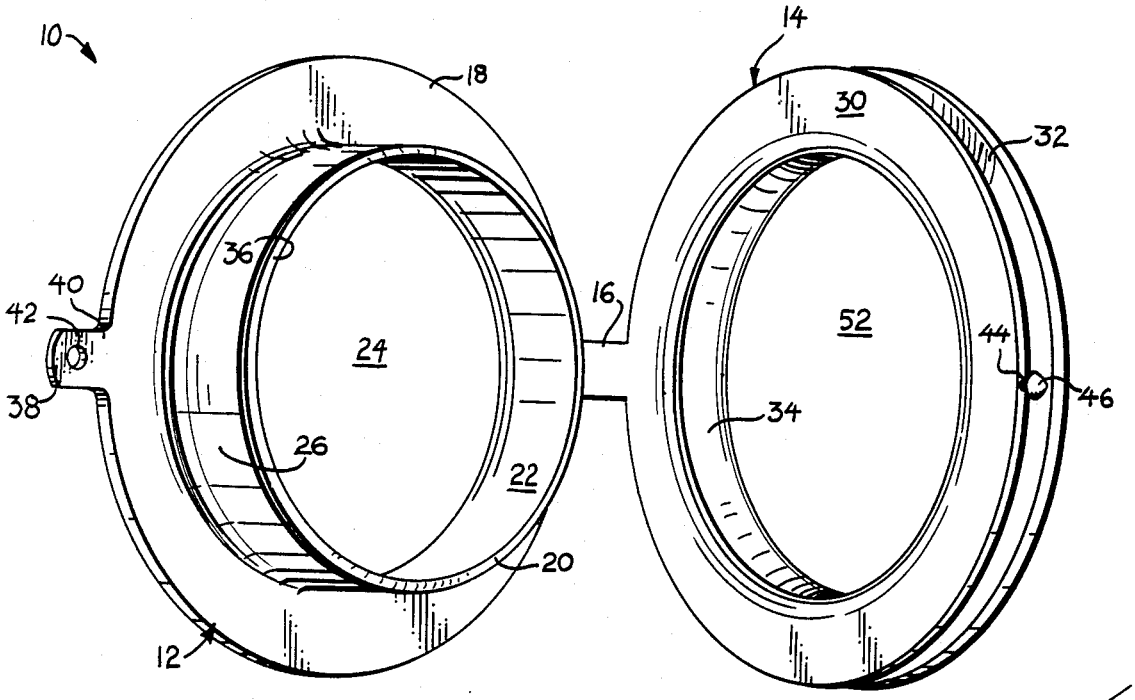
FIG. 2 is a perspective elevational view of the bag closure device shown in FIG. 1 but in a separated (i.e., opened) relationship.
Figure 3:
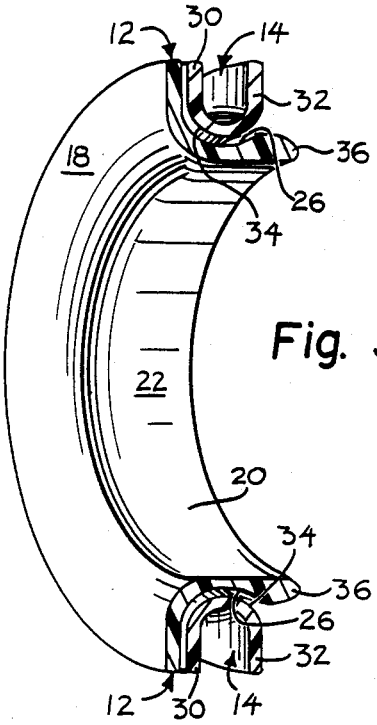
FIG. 3 is a cross-sectional elevational view of the bag closure device shown in FIG. 1 and taken along line 3—3 therein but not showing the flexible bag portion captured therebetween.

A bag closure device 10 according to this invention is seen more clearly in accompanying FIGS. 1–3. The device 10 is generally comprised of annular closure members 12 and 14 which are preferably joined to one another by means of an integral hinge 16 which facilitates foldable movement of the members 12, 14 between a nested relationship (i.e., as is shown in FIG. 1) and a separated relationship (i.e., as is shown in FIG. 2).

As is seen more clearly in FIG. 3, closure member 12 is preferably L-shaped in cross-sectional configuration. That is, member 12 is established by an upright flange 18 and a shelf 20 integrally connected to flange 18 and extending therefrom in a direction towards the other closure member 14. The inner surface 22 of shelf 20 establishes a cylindrical interior open area 24 (see FIG. 2) while the outer surface 26 of shelf 20 is concave which provides a seating surface against which a portion of the flexible bag 28 is captured when the closure members 12 and 14 are nested.

The other, U-shaped closure member 14 is established by an integral opposing pair of upright, spaced-apart wall segments 30, 32 joined at their respective bottoms so as to define a convex engagement surface 34. When the closure members 12 and 14 are nested with one another, the convex engagement surface 34 of member 14 will thus annularly surround the concave surface 26 of shelf 20 so as to capture, and thus close, a portion of the bag 28 therebetween.

The members 12 and 14 are preferably sized so that their respective seating and engagement surfaces, 26 and 34, are in physical contact with one another so as to more effectively seal and/or close the bag 28. However, it is also possible for the members 12 and 14 to be sized so that their respective seating and engagement surfaces, 26 and 34, are annularly spaced from one another when the members 12 and 14 are nested. In such a situation, the particular dimension of the spacing between the surfaces 26 and 34 is not critical, but should be selected so as to be less than the layer thickness of that portion of the bag 28 captured therebetween so that the bag will be firmly pressed between (and thus reliably closed by) the members 12 and 14.

In order to resist separation of the members 12 and 14 from their nested relationship, the end of shelf 20 preferably terminates in an enlarged annular lip 36. The lip 36 will bear against wall segment 32 of U-shaped member 14 when the members 12 and 14 are nested and thus serves to provide frictional resistance against members 12 and 14 separating from their nested relationship. Although the lip 36 is shown as being continuous, its functions may equivalently be provided by a series of lip segments spaced about the annular periphery of the terminal end of shelf 20—that is, a discontinuous form of lip 36. In addition, other structures could be employed at the end of shelf 20 in place of lip 36 so long as such structures provide the added frictional resistance mentioned above. For example, a strip of material having a relatively high friction coefficient could be adhered to the terminal end of shelf 20.

Figure 4:
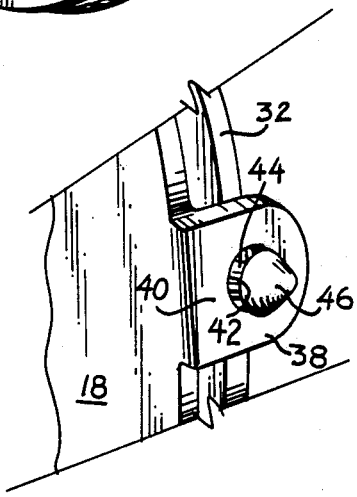
FIG. 4 is a detailed perspective view of one exemplary locking member in accordance with this invention.
Figure 5:
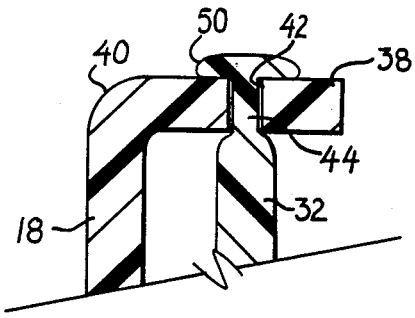
FIG. 5 is a partial cross-sectional elevation view of the tamper evident seal provided by the present invention.

Further locking functions may be provided with the device 10 of this invention so as to endure that the members 12 and 14 remain nested, yet permit a user to open the same when desired. One preferred locking member is shown in accompanying FIG. 4 as including a lock tab 38 integrally joined at its end 40 to flange 18 of member 12 (see also, FIG. 2). Lock tab 38 defines an aperture 42 which is sized and configured to receive the lock stake 44 formed on the wall segment 30 of member 14 when the tab 38 is folded at its end 40. The lock stake 44 is most preferably provided at its terminal end with an enlarged head 46 (i.e., as compared to the diameter of aperture 42) so that the head may be press-fitted through the aperture 42 and thus removably couple the tab 38 to the stake 44 thereby, in turn, removably coupling the two members 12 and 14 one to another.

Visual tamper evidence may be provided by at least partially melting the terminal end portion of stake 44 (as by bringing a heated tool, not shown, into contact with the stake 44) which extends through and beyond aperture 42 so that a region 50 of stake 48 melds with a subjacent region of tab 38. This melding of the stake 48 and tab 38 thus effectively provides a "seal" which is broken when the members 12 and 14 are separated so as to gain access to the contents of the bag 28. the broken seal, in turn, provides effective visual indication that the device, and hence the bag, has been previously opened. Of course, this is not a concern if it is the consumer which opens the bag. But, if the bag has been opened prior to consumer purchase, the tamper evidence provided by the stake/tab 44/38 warns the purchaser that the contents of the bag 28 may have been adulterated in some manner.

The device 10 of this invention may, if desired, conveniently be fabricated entirely of a plastic material by any technique well known to those in the plastic fabrication art. Preferably, the device 10 is injection-molded from any suitable conventional injection-moldable resin. The particular selection of a resin will depend upon many factors including its chemical and physical properties, appearance when molded, and cost, to name just a few. Suffice it to say here that the resulting device 10 may be comprised of a plastic material which is shaped-retaining, yet is somewhat resilient. In addition, however, it is possible to use other materials (either with or without plastic) to form the subject matter of this invention.

In use, the upper end of the bag 28 is draped over portions of the wall segment 30 of member 14 when the members 12 and 14 are in a separated relationship (i.e., as is shown in FIG. 2) so that the bag 28 spans the interior open area 52 circumscribed by the convex engagement surface 34. The user may twist the upper end of bag 28, if desired. The closure member 12 may then be folded into opposing relationship with member 14 (as is more easily permitted by means of hinge 16) so that the lip 36 of shelf 20 registers with the convex engagement surface 34. Thereafter, the members 12 and 14 may be forced into a nested relationship so that portions of the bag 28 are captured between the convex and concave surfaces 34 and 26 of members 14 and 12, respectively. Also, it will be seen from FIG. 1, that another portion of the bag is captured between flange 18 and wall segment 30 thereby further contributing to bag closure.

It will be appreciated that forcing the shelf 20 of member 12 into nested relationship with the convex surface 34 of member 14 may cause the members 12 and/or 14 to be deformed somewhat (e.g., in the particular embodiment shown in the accompanying drawings, members 12 and/or 14 may deform to an extent that they are no longer circular). This deformation is not disadvantageous and, in fact, may promote more reliable closing of the bag 28 and frictional nesting of the members 12 and 14. That is, deformation of the members 12 and/or 14 may serve to increase the frictional engagement therebetween and thus, in turn, more reliably close the bag 28.

Although each of the members 12 and 14 of the preferred embodiment of device 10 is shown in the accompanying drawings as being circular in configuration, other geometric forms can be utilized.

Thus, while the present invention has been described in connection with what is presently considered to be the most practical and preferred embodiment, it is to be understood that the invention is not be limited to the disclosed embodiment, but on the contrary, is intended to cover various modifications and equivalent arrangements included within the spirit and scope of the appended claims.

What is claimed is:

1. A bag closure device comprising:

a pair of annular closure members;

one of said closure members being substantially L-shaped in cross-sectional configuration thereby establishing a flange and a seating surface;

the other of said closure members being substantially U-shaped in cross-sectional configuration thereby establishing a pair of upright wall sections joined to one another at their bottoms so as to define an engagement surface;

said pair of annular closure members being nestable with one another such that said engagement surface of said other closure member is annularly adjacent said seating surface of said one closure member thereby capturing a portion of a bag disposed therebetween, and such that said flange of said one closure member is adjacent one of said wall sections of said other closure member thereby capturing a remaining portion of said bag therebetween, whereby said bag is closed; and wherein said bag closure device further comprises hinge means joining said one and other of said closure members to permiit same to be foldable into and out of a nested relationship with one another so as to respectively close and open said bag.

2. A bag closure device as in claim 1, wherein said annular closure members are each substantially circular.

3. A bag closure device as in claim 1, wherein said hinge means is integral with said one and other closure members.

4. A bag closure device as in claim 1, wherein said one closure member includes retaining lip means formed at a terminal end of said seating surface for contacting the other of said wall sections of said other closure member when said pair of closure members are nested with one another to thereby provide frictional resistance against separation of said nested pair of closure members.

5. A bag closure device as in claim 1, further comprising locking means for removably locking said pair of closure members in a nested relationship with one another.

6. A bag closure device as in claim 5, wherein said locking means includes;

a lock stake having an enlarged head portion formed on said other closure member; and a lock tab formed on said one closure member and defining an aperture which is sized and configured to permit said head of said lock stake to be press-fitted therethrough so as to removably lock said pair of closure members in said nested relationship.

7. A bag closure device as in claim 5, wherein said locking means includes;

a lock tab formed on said one closure member and defining an aperture;

a lock stake formed on said other closure member and extended through said aperture; and tamper evidence means for providing a visual indication that said lock stake has been removed from said aperture of said lock tab.

8. A bag closure device as in claim 7, wherein said tamper evidence means is provided by a melted terminal end segment of said lock stake which extends beyond said lock tab.

9. A device adapted for closing an open end of a flexible bag comprising:

first and second annular members movable relative to one another between a nested relationship wherein an end of a flexible bag is captured and thus closed therebetween, and a separated relationship wherein the end of the flexible bag is released and thus capable of being opened;

said first closure member defining a concave seating surface;

said second closure member defining a convex engagement surface sized and configured so as to be in at least a closely adjacent annular position relative to said concave seating surface of said first closure member when said first and second closure members are in said nested relationship;

said respective concave and convex surfaces of said first and second members collectively providing means for frictionally capturing a portion of the flexible bag end therebetween thereby closing the same, wherein said first closure member is substantially L-shaped in cross-section and thus establishes an upright flange and a shelf extending outwardly from said flange;

said concave seating surface is defined by said shelf of said L-shaped closure member;

said second closure member is substantially U-shaped in cross-section and thus establishes an opposing pair of upright wall sections joined at their bottoms to define said convex engagement surface;

said flange of said first closure member being positioned adjacent to one of said wall sections of said second closure member when said first and second closure members are in said nested relationship so as to further capture a remaining portion of said flexible bag therebetween.

10. A device as in claim 9, further comprising retainer means for releasably retaining said first and second closure members in said nested relationship.

11. A device as in claim 10, wherein said retainer means includes an annular lip formed at a terminal end of said first closure member, said lip bearing against said second closure member to thereby frictionally resist separation of said first and second members when in said nested relationship.

12. a device as in claim 11 wherein, said annular lip is formed at a terminal end region of said shelf.

13. A device as in claim 10 or 11, wherein said retainer means includes locking means for removably locking said pair of closure members in said nested relationship with one another.

14. A device as in claim 13, wherein said locking means includes;

a lock stake having an enlarged head portion and formed on one of said first and second closure members; and a lock tab formed on the other of said closure members and defining an aperture which is sized and configured to permit said head of said lock stake to be press-fitted therethrough so as to removably lock said first and second closure members in said nested relationship.

15. A device as in claim 13, wherein said locking means includes;

a lock tab formed on one of said first and second closure members and defining an aperture;

a lock stake formed on the other of said first and second closure members and extended through said aperture; and tamper evidence means for providing a visual indication that said lock stake has been removed from said aperture of said lock tab.

16. A device as in claim 15, wherein said tamper evidence means is provided by a melted terminal end segment of said lock stake which extends beyond said lock tab.

17. A device as in claim 9, further comprising hinge means joining said first and second closure members to permit same to be foldable into and out of said nested relationship with one another so as to respectively close and open said bag.

18. A device as in claim 17, wherein said hinge means is integral with said first and second closure members.

19. A device as in claim 9, wherein each said annular closure member is substantially circular.

20. A closed bag comprising, in combination, a flexible bag having an upper end region which is openable so as to permit access to contents of the bag, and a bag closure device attached to said upper end region of said bag so as to close the same, said bag closure device including;

a pair of closure members movable into and out of a nested relationship with one another;

each said closure member being annular in configuration so as to establish an interior open area;

one of said closure members being substantially L-shaped in cross-sectional configuration thereby defining a flange and a seating surface, and the other of said closure members being substantially U-shaped in cross-sectional configuration thereby defining a convex engagement surface;

said pair of annular closure members being nestable with one another such that said engagement surface of said other closure member is annularly adjacent said seating surface of said one closure member thereby capturing a portion of said bag disposed therebetween; and wherein said upper end region of said bag extends across said open areas of said annular closure members when said portion thereof is positioned, and thus captured, between said pair of closure members, whereby said bag is closed.

21. A closed bag as in claim 20, wherein said annular closure members are each substantially circular.

22. A closed bag as in claim 20, further comprising hinge means joining said one and the other of said closure members to permit same to be foldable into and out of a nested relationship with one another so as to respective close and open said bag.

23. A closed bag as in claim 22, wherein said hinge means is integral with said one and other closure members.

24. A closed bag as in claim 20, wherein said one closure member includes retaining lip means formed at a terminal end of said seating surface for contacting said other closure member when said pair of closure members are nested with one another to thereby provide frictional resistance against separation of said nested pair of closure members.

25. A closed bag as in claim 20, further comprising locking means for removably locking said pair of closure members in a nested relationship with one another.

26. A closed bag as in claim 25, wherein said locking means includes;

a lock stake having an enlarged head portion formed on said other closure member; and a lock tab formed on said one closure member and defining an aperture which is sized and configured to permit said head of said lock stake to be press-fitted therethrough so as to removably lock said pair of closure members in said nested relationship.

27. A closed bag as in claim 25, wherein said locking means includes;

a lock tab formed on said one closure member and defining an aperture;

a lock stake formed on said other closure member and extended through said aperture; and tamper evidence means for providing a visual indication that said lock stake has been removed from said aperture of said lock tab.

28. A closed bag as in claim 27, wherein said tamper evidence means is provided by a melted terminal end segment of said lock stake which extends beyond said lock tab.

29. A bag closure device comprising:

a pair of annular closure members;

one of said closure members being substantially L-shaped in cross-sectional configuration thereby establishing a flange and a seating surface;

the other of said closure members being substantially U-shaped in cross-sectional configuration thereby establishing a pair of upright wall sections joined to one another at their bottoms so as to define an engagement surface;

said pair of annular closure members being nestable with one another such that said engagement surface of said other closure member is annularly adjacent said seating surface of said one closure member thereby capturing a portion of a bag disposed therebetween, and such that said flange of said one closure member is adjacent one of said wall sections of said other closure member thereby capturing a remaining portion of said bag therebetween, whereby said bag is closed, and locking means for removably locking said pair of closure members in a nested relationship with one another, wherein said locking means includes (i) a lock tab formed on said one closure member and defining an aperture, (ii) a lock stake formed on said other closure member and extended through said aperture; and (iii) tamper evidence means for providing a visual indication that said lock stake has been removed from said aperture of said lock tab.

30. A bag closure device as in claim 29, wherein said tamper evidence means is provided by a melted terminal end segment of said lock stake which extends beyond said lock tab.

* * * * *